US006054799A

United States Patent [19]

Stefano

[11] Patent Number: 6,054,799

[45] **Date of Patent: *Apr. 25, 2000**

[54] TORQUE SOCKET FOR AN OXYGEN SENSOR OR A MODIFIED SPARK PLUG

[76] Inventor: Alfonso Di Stefano, 1430 Wayburn, Grosse Pointe Park, Mich. 48230

[ * ] Notice: This patent issued on a continued prosecution application filed under 37 CFR 1.53(d), and is subject to the twenty year patent term provisions of 35 U.S.C. 154(a)(2).

[21] Appl. No.: 08/893,771

[22] Filed: Jul. 11, 1997

[51] Int. Cl.[7] ..... H01T 13/38; B25B 13/00

[52] U.S. Cl. ..... 313/118; 81/121.1; 81/124.2

[58] Field of Search ..... 313/118; 81/121.1, 81/124.2

[56] References Cited

U.S. PATENT DOCUMENTS

| | | | |
|---|---|---|---|
| 2,503,364 | 4/1950 | Viets | 81/121.1 |
| 4,096,621 | 6/1978 | Berger et al. | 81/121.1 |
| 4,984,489 | 1/1991 | Krauthamer | 81/121.1 |
| 5,257,556 | 11/1993 | Pinehault | 81/124.2 |
| 5,450,772 | 9/1995 | Barone et al. | 81/121.1 |

*Primary Examiner*—Nimeshkumar D. Patel
*Assistant Examiner*—Joseph Williams
*Attorney, Agent, or Firm*—Christopher P. Maiorana, P.C.

[57] ABSTRACT

A socket that can be adapted to insert and remove an oxygen sensor or a modified spark plug. The socket has a open portion that may be used to accommodate an electrical portion of an oxygen sensor while maintaining proper functioning of the socket. The open portion extends through a portion of the socket while leaving an intact bottom portion, allowing much of the strength of a conventional socket to be maintained.

8 Claims, 1 Drawing Sheet

TORQUE SOCKET FOR AN OXYGEN SENSOR OR A MODIFIED SPARK PLUG

FIELD OF THE INVENTION

The present invention relates to hand tools generally and, more particularly, to a socket adapted for use with an oxygen sensor or modified spark plug.

BACKGROUND OF THE INVENTION

Conventional oxygen sensors typically include a sensing device coupled to an electrical portion. FIG. 1 illustrates a typical configuration of an oxygen sensor. The oxygen sensor 10 is shown generally coupled to an electrical portion 12. Since the electrical portion 12 is generally permanently affixed to the oxygen sensor 10, it is generally impractical to use a conventional socket to remove the oxygen sensor 10. A conventional socket cannot generally be connected around the oxygen sensor 10 due to the electrical portion 12. Conventional tools used to insert and remove an oxygen sensor include a wrench having an open portion as shown in U.S. Pat. No. 4,096,621. The open portion of the socket generally extends sufficiently to accommodate the fastening portion of a flat metal lock. However, the open portion generally causes the entire wrench to be weakened. While previous approaches may implement heat treated metal to strengthen the socket, the overall design may still be weaker than desired. Additionally, the sockets in the prior art having open end portions are clearly not the equivalent of a conventional socket since the open portion breaks the continuity of the socket. Additionally, the sockets in the prior art are generally not suitable to accommodate an oxygen sensor (or modified spark plug) including an electrical coupling.

Despite the long felt need, the prior art does not appear to have provided a solution to removing and installing an oxygen sensor using a conventional socket.

SUMMARY OF THE INVENTION

The present invention concerns a socket that can be adapted to insert and remove an oxygen sensor or a modified spark plug. The socket has a open portion that may be used to accommodate an electrical portion of an oxygen sensor while maintaining proper functioning of the socket. The open portion extends through a portion of the socket while leaving an intact bottom portion, allowing much of the strength of a conventional socket to be maintained.

The objects, features and advantages of the present invention include providing a socket that may be used to remove an oxygen sensor, a socket that may be used to remove a modified spark plug and a modified spark plug that extends the useful life of spark plug wires.

In an alternate embodiment of the present invention, a modified spark plug is provided which provides a permanent, or semi-permanent, connection between the spark plug and the spark plug wire. The socket of the present invention may be used to install such a modified spark plug without disturbing the electrical connection between the spark plug wire and the spark plug.

BRIEF DESCRIPTION OF THE DRAWINGS

These and other objects, features and advantages of the present invention will be apparent from the following detailed description and the appended claims and drawings in which:

DETAILED DESCRIPTION OF THE PREFERRED EMBODIMENTS

Figure 2:
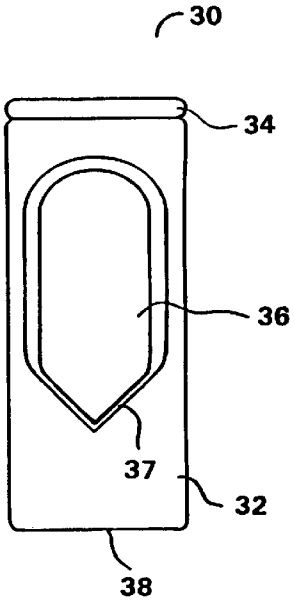
FIG. 2 is side view of a preferred embodiment of the present invention.

Referring to FIG. 2, a side view of a socket 30 is shown in accordance with a preferred embodiment of the present invention. The socket 30 generally comprises a body portion 32, a top portion 34 and cut-out portion 36. The top portion 34 is generally configured similarly to a conventional socket having a cut-out portion 36 suitable to receive the drive portion of a hand held ratchet or mechanically driven impact wrench (not shown). Additionally, a bottom portion 38 provides a generally open passage for the wire and oxygen sensor (or spark plug) to be inserted. The cut-out portion 36 allows the wire 12 of the oxygen sensor 10 to be inserted, while maintaining the proper functioning of the socket 30. The configuration of the socket 30 provides a high overall strength without requiring heat treating.

Figure 1:
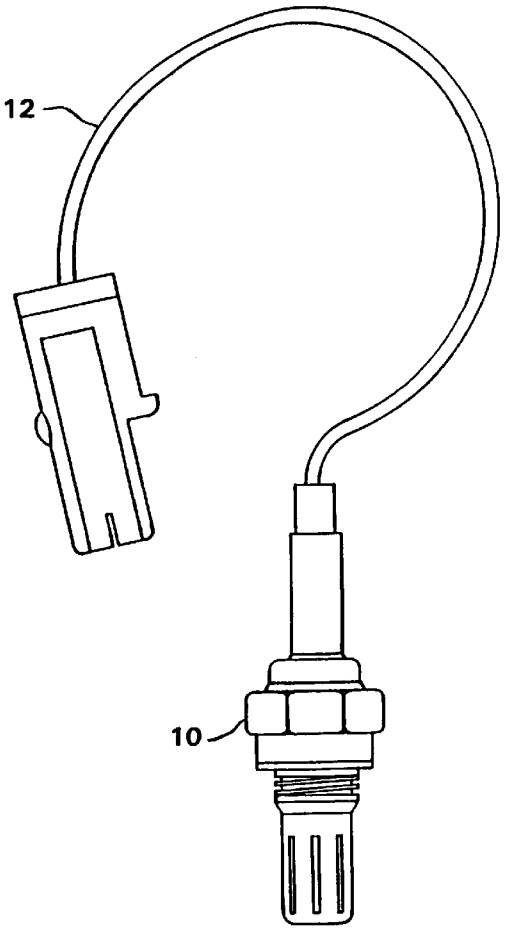
FIG. 1 is a diagram of a conventional oxygen sensor.
Figure 3:
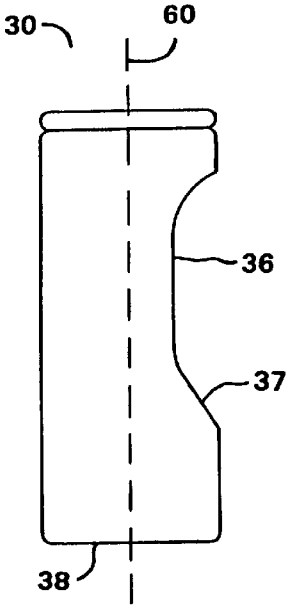
FIG. 3 is a second side view of a preferred embodiment.

Referring to FIG. 3, a second side view of a preferred embodiment of the present invention is shown. The cut-out portion 36 is shown generally having a shape that is tapered toward the bottom portion 38. The additional tapered end portion 37 provides additional area for the wire 12 to be inserted. The tapered end portion 37 may be, in one example, the general shape of a V. An angle of less than 90 degrees between the legs of the V may be implemented in one example. However, other angles may be implemented to maximize the strength of the socket 30.

Figure 4:
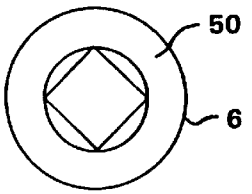
FIG. 4 is a top view of a preferred embodiment.
Figure 5:
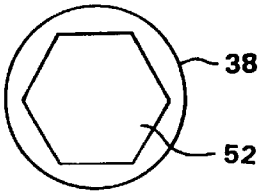
FIG. 5 is a bottom view of a preferred embodiment.

Referring to FIGS. 4 and 5, a top and bottom view of the socket 30 is shown. The top view illustrates a drive portion 50 that allows a conventional ratchet (not shown) to be inserted. A bottom portion 38 includes an open portion 52 which allows the oxygen sensor (or modified socket) to be inserted.

While the socket 30 has been primarily described in connection with an oxygen sensor having a permanently attached wire 12, the present invention may be adapted to provide for securing an improved spark plug having an ignition wire permanently, or semi-permanently, attached to a body portion. If the ignition wire 12 is adapted with an alternate fastening means (not shown) that provides a crimping type connection to the spark plug, a more secure semi-permanent connection may be made. With such an improved spark plug, conventional sockets would fail since the semi-permanently attached wire 12 would not allow the socket 30 to properly connect to the spark plug. With the present invention, the wire 12 may be inserted through the opening 36 to allow the spark plug to be installed with the wire semi-permanently attached. Such a configuration may allow for maintenance (i.e., removal) of the spark plug without damaging the electrical connection between the wire 12 and the spark plug.

In a additional alternate embodiment spark plug, the ignition wire may be permanently soldered to the spark plug. The socket 30 may still allow for installation and removal of the spark plug.

Referring back to FIG. 3, a particular configuration of the open portion 36 is shown. A dotted line 52 generally represents the center portion of the socket 30. The open portion 36 is shown to be cut-away from the socket 30 in an amount that generally does not cross the center portion 60. As a result, the strength of the socket 30 may be increased. In one example, the open portion is less than one third of the diameter of the socket 30. However, other configurations of the open portion 36 may be implemented. For example, a vertical slot (not shown) may be made in the bottom portion of the socket 30 to allow the wire 12 to freely move. While such a vertical slot may decrease the overall strength of the socket 30, it may provide a desirable operation in certain applications.

While the invention has been particularly shown and described with reference to the preferred embodiments thereof, it will be understood by those skilled in the art that various changes in form and details may be made without departing from the spirit and scope of the invention.

What is claimed is:

1. A socket for driving an external piece having an attached wire, said socket comprising:

an outer housing having an open bottom portion and a side portion;

a top portion configured to receive a driving device;

a bottom portion configured to couple to said external piece; and a single open portion cut into said side portion, wherein said single open portion allows said wire connected to said external piece to pass through said side portion, wherein said single open portion is enclosed between said bottom portion and said top portion.

2. The socket according to claim 1 wherein said single open portion comprises less than one third of a diameter of said side portion.

3. The socket according to claim 1 wherein said single open portion comprises one half of said side portion.

4. The socket according to claim 1 wherein said single open portion comprises a tapered end portion.

5. The socket according to claim 4 wherein said tapered end portion comprises a V-shaped end having an angle of less than 90 degrees between a first and a second leg of the V.

6. A socket for driving an external piece having an attached wire, said socket comprising:

an outer housing having an open bottom portion and a side portion;

a top portion configured to receive a driving device;

a bottom portion configured to couple to said external piece; and an open portion comprising a tapered end portion having a V-shaped end cut into said side portion, wherein said open portion allows said wire connected to said external piece to pass through said side portion, wherein said open portion is enclosed between said bottom portion and said top portion.

7. The socket according to claim 6 wherein said V-shaped end has an angle of less than 90 degrees between a first and a second leg of the V.

8. A socket for driving an external piece having an attached wire, said socket having a single open portion, said socket comprising:

an outer housing having an open bottom portion and a side portion; and a top portion configured to receive a driving device;

a bottom portion configured to couple to said external piece;

wherein said single open portion is cut into said side portion, wherein said single open portion allows said wire connected to said external piece to pass through said side portion, wherein said single open portion is enclosed between said bottom portion and said top portion.

* * * * *